US007025218B1

(12) United States Patent
McMurray et al.

(10) Patent No.: US 7,025,218 B1
(45) Date of Patent: Apr. 11, 2006

(54) BILLBOARD ADVERTISING COPY HOIST SYSTEM

(75) Inventors: Robert B. McMurray, Brookfield, WI (US); Paul T. Riedl, New Berlin, WI (US)

(73) Assignee: TPI Technology Group, Inc., Wauwatosa, WI (US)

( * ) Notice: Subject to any disclaimer, the term of this patent is extended or adjusted under 35 U.S.C. 154(b) by 99 days.

(21) Appl. No.: 10/278,086

(22) Filed: Oct. 21, 2002

(51) Int. Cl.
*B66C 23/20* (2006.01)

(52) U.S. Cl. ..... 212/179; 212/253; 212/347

(58) Field of Classification Search ..... 212/179, 212/253, 347
See application file for complete search history.

(56) References Cited

U.S. PATENT DOCUMENTS

| | | | | | |
|---|---|---|---|---|---|
| 971,686 | A | * | 10/1910 | Michael et al. | 212/176 |
| 2,109,304 | A | * | 2/1938 | Ormsby | 212/253 |
| 3,998,458 | A | | 12/1976 | Inoue et al. | |
| 4,000,896 | A | | 1/1977 | Lauraitis | |
| 4,125,260 | A | | 11/1978 | Kanne et al. | |
| 4,135,035 | A | | 1/1979 | Branen et al. | |
| 4,184,600 | A | * | 1/1980 | Goss et al. | 212/270 |
| 4,288,075 | A | | 9/1981 | Kaugars et al. | |
| 4,290,584 | A | | 9/1981 | Eckels et al. | |
| 4,555,113 | A | | 11/1985 | Shimazaki et al. | |
| 4,867,091 | A | * | 9/1989 | Arisato et al. | 114/97 |
| 5,022,652 | A | | 6/1991 | Fenton | |
| 5,042,208 | A | | 8/1991 | Richardson | |
| 5,049,422 | A | | 9/1991 | Honma | |
| 5,072,962 | A | | 12/1991 | Webb | |
| 5,156,396 | A | | 10/1992 | Akatsuka et al. | |
| 5,240,229 | A | * | 8/1993 | Timmons | 254/338 |
| 5,242,721 | A | | 9/1993 | Oonuki et al. | |
| 5,285,603 | A | | 2/1994 | Richard et al. | |
| D358,696 | S | * | 5/1995 | Mims | D34/28 |
| 5,427,440 | A | | 6/1995 | Ward et al. | |
| 5,487,478 | A | * | 1/1996 | Morrow | 212/253 |
| 5,549,947 | A | | 8/1996 | Quigley et al. | |
| 5,634,861 | A | | 6/1997 | Yamamoto et al. | |
| 5,690,240 | A | | 11/1997 | Thiermann, Sr. | |
| 5,692,970 | A | | 12/1997 | Nelson | |
| 5,720,400 | A | | 2/1998 | Altizer, Sr. | |
| 5,743,809 | A | | 4/1998 | Lehman | |
| 5,797,504 | A | | 8/1998 | Mangum | |
| 5,799,807 | A | | 9/1998 | Hamme | |
| 5,820,455 | A | * | 10/1998 | Breedlove | 452/187 |
| 5,901,864 | A | | 5/1999 | Morrow | |
| 5,909,783 | A | | 6/1999 | Berish | |
| 5,918,328 | A | * | 7/1999 | Ramsey | 5/84.1 |
| 5,944,441 | A | * | 8/1999 | Schutze | 403/403 |

(Continued)

OTHER PUBLICATIONS

FORMETCO Jib Pole Specifications "The Formetco Stainless Steel Material Handling Winch", Formetco, Inc., 2963 Pleasant Hill Road, Duluth, GA 30096, 5 pgs.

(Continued)

*Primary Examiner*—Thomas J. Brahan
(74) *Attorney, Agent, or Firm*—Foley & Lardner LLP

(57) ABSTRACT

A hoist system can be used to raise articles. The hoist system can include a composite pole member having a bend, a mounting structure attachable to the composite pole member and a winch assembly. The winch assembly has at least one component attached to the pole. The winch assembly is capable of winding a flexible line. The hoist system can be utilized to raise and lower vinyls, other signage equipment or tools to billboard structures. The composite pole can be a single piece unit having a bend.

26 Claims, 6 Drawing Sheets

U.S. PATENT DOCUMENTS

| | | | | |
|---|---|---|---|---|
| 5,954,157 | A * | 9/1999 | Grimes et al. | 182/163 |
| 5,961,396 | A | 10/1999 | Morell et al. | |
| 6,056,648 | A | 5/2000 | Kusumoto et al. | |
| 6,095,080 | A * | 8/2000 | Weber | 114/370 |
| 6,138,991 | A * | 10/2000 | Myers, Jr. | 254/323 |
| 6,183,233 | B1 | 2/2001 | Preece et al. | |
| 6,192,958 | B1 | 2/2001 | Yamamoto et al. | |
| 6,197,232 | B1 | 3/2001 | Stevens | |
| 6,321,872 | B1 * | 11/2001 | Parker | 182/3 |
| 6,367,225 | B1 | 4/2002 | Ashton | |
| 6,422,538 | B1 | 7/2002 | Rumfield | |
| 6,467,117 | B1 * | 10/2002 | Lantz et al. | 14/6 |
| 6,725,950 | B1 * | 4/2004 | Palm | 175/162 |
| 6,786,233 | B1 * | 9/2004 | Anderson et al. | 137/615 |
| 2001/0050263 | A1 | 12/2001 | Freeman | |

OTHER PUBLICATIONS

Canadian Safety Equipment Inc. website @ http://www.cdn-safety.com/company/unihoist.html, Updated Apr. 28, 2002, retrieved Jul. 16, 2002, 5 pgs.

National Safety, Inc., General Specifications: Pole Hoists website @ http://www.nationalsafetyinc.com/UCL/Polehoists2.htm, Last modified: Jun. 14, 2000, retrieved Jul. 16, 2002, 2 pgs.

Halliday Products "Portable Hoists" website @ http://halliday.com/hoists.htm, retrieved Jul. 16, 2002, 1 pg.

Affidavit of Robert B. McMurray with attached Exhibits A-E, 8 pgs.

* cited by examiner

BILLBOARD ADVERTISING COPY HOIST SYSTEM

FIELD OF THE INVENTION

The present invention relates generally to hoist and/or crane systems. More particularly, the present invention relates to a portable or mobile system which can be utilized to hoist or lift materials.

BACKGROUND OF THE INVENTION

Hoist systems and cranes are used in a variety of applications for lifting a variety of materials. Construction sites often use hoists and cranes to lift building materials and the like. Another application relates to the lifting of signs and the installation of advertising copy at billboard sites. Advertising copy can include images placed primarily on vinyl films or wood. Wood is often used for extensions or cut-outs which extend above or beyond the typical rectangular-shaped billboard.

In the billboard industry, billboards are comprised of a billboard structure and faces. The faces are mounted on an area on the billboard structure where advertising copy is typically displayed. Advertising copy includes graphics, images, or text, and is usually placed on vinyl film or wood. The advertising copy can be changed when it is desirable to change the message or advertisement on the billboard. Alternatively, the billboard can utilize paper, cardboard, wood, plastic film, or other materials as the surface for holding the images which are attached to the face of the billboard.

Heretofore, the advertising copy was lifted onto the billboard faces manually, either by pulling a rope up by hand (roping), by utilizing generic block and tackle, or with the assistance of a crane truck. Roping can be strenuous and tiring, and requires younger, stronger people to perform this task on a regular and continuing basis. Utilizing generic block and tackle requires extensive set-up time and can require more than one person. Further, generic block and tackle is not well suited to the positioning requirements associated with advertising copy replacement on a billboard structure.

Crane trucks are relatively expensive pieces of equipment. Further, the use of a crane truck requires that the operating area surrounding the billboard be clear of obstacles, power lines, etc. Billboard structures are frequently located in remote areas or areas which are difficult to access. For example, billboard structures that are located in farmer fields, railroad right-of-ways, junkyards, parking lots, snowed-in areas, etc. are often difficult to access with a large piece of equipment.

U.S. patent application publication U.S. 2001/0050263A1 discloses a portable aluminum jib crane with an attached nip roller drive system for lifting billboard vinyls. The nip roller drive system utilizes two rollers to raise and lower a flat rope. The drive roller assembly is mounted upon a subframe comprised of two square tubing members. The square tubing members can be mounted in a female square tubing member which is attached to a trolley. The trolley can be configured to ride on an I-beam associated with the billboard structure.

Heretofore, hoist systems for billboards have been complicated and heavy, requiring more than one person or the use of equipment to bring the hoist system to the top of the billboard structure. Further, such systems have been difficult to mount onto the billboard structure. Billboard structures vary in size and requires a mounting system which can adapt to the various types of billboard structures. Moreover, such systems have been electrically conductive, making it more dangerous for a person to utilize the system.

Thus, there is a need for a hoist system which is portable and lightweight. Further, there is a need for a hoist system which can be easily mounted on a variety of billboard structures. Further still, there is a need for a hoist system which is manufactured from relatively lightweight components. Yet further, there is a need for a low-cost hoist system. Even further still, there is a need for a hoist system optimized for the replacement of advertising copy. Still further, there is a need for an electrically non-conductive hoist system.

SUMMARY OF THE INVENTION

An exemplary embodiment relates to a lightweight hoist system for raising an article. The hoist system includes a composite pole member having a bend, a mounting structure attachable to the composite pole member and attachable to a billboard structure, and a winch assembly. The winch assembly is attached to the pole. The winch assembly is capable of winding a flexible line.

Another exemplary embodiment relates to a pole member for a hoist system. The hoist system is for raising items such as vinyls, extensions, equipment or tools when installing advertising copy on the faces of billboards. The pole member includes a composite material having fibers. The fibers are wound at an angle or a combination of angles. The pole member has a first end and a second end and is bent at a location between the first end and the second end.

Still another exemplary embodiment relates to a mounting structure for securing a pole member of a hoist system to a billboard structure. The mounting structure includes a first bearing for securing the pole member at or near a first end and a second bearing for securing the pole member at a point closer to a second end of the pole member than the first bearing. The second end is opposite the first end. The mounting structure also includes a frame which can be variably coupled to the billboard structure.

Yet another embodiment relates to a lightweight hoist system for raising an article. The hoist system includes a composite pole member, a mounting structure and a winch assembly. The composite pole member includes a ring bearing for engaging the mounting structure.

BRIEF DESCRIPTION OF THE DRAWINGS

The exemplary embodiments will hereafter be described with reference to the accompanying drawings, wherein like reference numerals denote like elements in the various drawings, and.

DETAILED DESCRIPTION OF PREFERRED EXEMPLARY EMBODIMENTS

Figure 1:
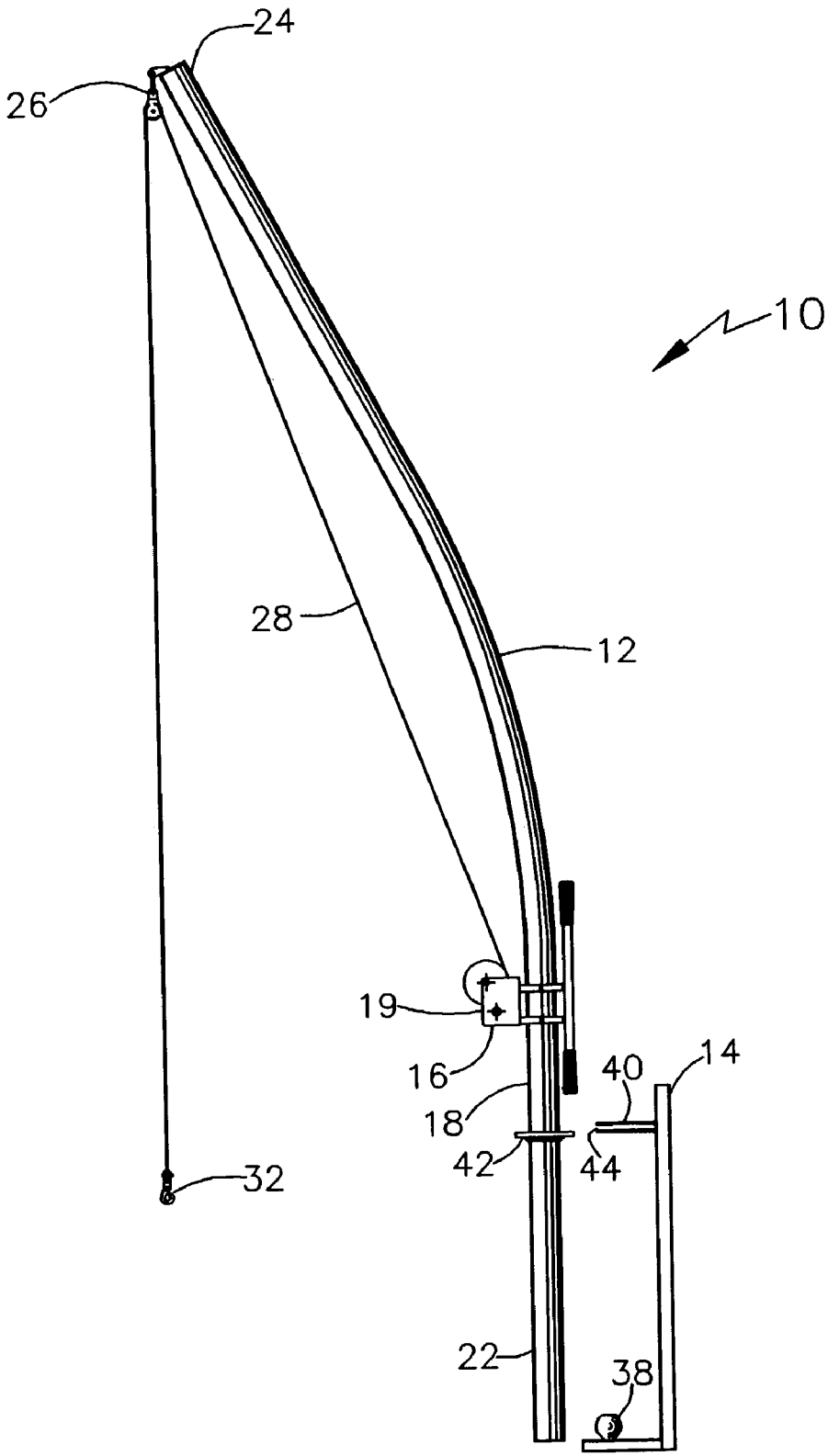
FIG. 1 is a side view planar schematic drawing of a hoist system in accordance with an exemplary embodiment, the hoist system includes a mounting structure, a pole member, and a winch assembly.

With reference to FIG. 1, a hoist system 10 includes a pole member 12, a mounting structure 14, and a winch assembly 16. Hoist system 10 can be utilized in a variety of applications and is preferably optimized for raising and lowering advertising copy to billboard faces.

Various features of hoist system 10 contribute to its advantageous use in a variety of applications and environments. The combination of mounting structure 14, bearing 42, pole member 12, and winch assembly 16 provides significant advantages for certain applications. Although discussed below with respect to raising billboard vinyls and other signage, hoist system 10 can be utilized in other applications where lightweight equipment for lifting articles is advantageous.

Hoist system 10 is preferably a lightweight system that can be operated and installed by a single person. Hoist system 10 can be utilized to lift loads less than 250 pounds, although the description of hoist system 10 is not limited to such a rating.

Winch assembly 16 is preferably attached to a center portion 18 of pole element or member 12. Center portion 18 is between a bottom end 22 and a top end 24 of pole element or member 12. Pole member 12 is preferably rotatable with respect to mounting structure 14 so that vinyls and other signage can be moved across the face of the billboard as necessary.

Winch assembly 16 is fixed with respect to pole member 12 and is used to raise and lower a line 28 to manipulate vinyls or other signage on a billboard structure. Pole member 12 is bent to enable positioning of the vinyls or other signage and to provide appropriate clearance as vinyls or other signage are raised and lowered. Hoist system 10 allows vinyls or other signage to be rotated up to 360 degrees.

Winch assembly 16 includes a pulley 26 attached at top end 24 of pole element 12 and a crank assembly 19 attached at center portion 18. A clamping bracket or other hardware can be used to attach winch assembly 16 to pole member 12. Any number of block and tackle or other bearings can be utilized with winch assembly 16. Preferably, winch assembly 16 can be driven by a portable electric drill. Alternatively, assembly 16 can include a crank or can otherwise be manipulated manually to wind and unwind line 28. Line 28 can include a hook or other attachment device 32.

Attachment device 32 can engage a tube upon which a vinyl is rolled. The vinyl can be unrolled from the tube when it is installed on the billboard structure. Attachment device 32 can include a rotatable joint which allows the vinyl to be handled more easily. In an application which uses bundled vinyls, attachment device 32 can engage a strap that is wrapped around the bundle. Attachment device 32 can also engage a carabiner. Other equipment, tools, extensions, cut-outs, etc. can be raised by hoist system 10. Advantageously, hoist system 10 is capable of raising cut-outs and extensions above the top of the billboard structure due to the height of pole member 12.

Preferably, line 28 is a one-eighth inch or 7×19 galvanized or stainless steel wire rope with a breaking strength of at least 2,000 pounds, or a one-eighth inch stranded synthetic rope with a breaking strength of at least 2,000 pounds for non-metallic applications. Alternatively, line 28 can be a flat belt, a nylon cord, a chain, a rope, or a cable. Pulley 26 is preferably a fixed block with a two-inch or larger sheave size to handle line 28.

Winch assembly 16 can be operated via a portable electric hand drill (cordless DC or corded AC). Preferably, an electric one-half inch drill, such as those manufactured by Milwaukee Electric Tool Corporation of Wisconsin, can be utilized to drive winch assembly 16. Advantageously, the portable hand drill is easy to transport up to the billboard structure and does not need to remain on the billboard structure (as a fixed motor unit does) where it is exposed to the environment. Alternatively, winch assembly 16 can include an electric motor coupled to a battery or an AC power source.

Winch assembly 16 is preferably operable from either side and includes a braking system. Operation from either side is particularly advantageous as pole member 12 is rotated, and is achieved by applying the power source to either end of the drive shaft. The drive shaft extends from winch assembly 16 in opposite directions on both sides to permit engagement from either side.

Access on either side of winch assembly 16 is important due to the narrow walkway associated with the typical billboard structure. The ability to drive winch assembly 16 from either side allows safe and effective operation as pole member 12 is rotated and vinyls and other signage are moved across the face of the billboard structure. Winch assembly 16 can be a winch system such as a DLB1550 Winch manufactured by Dutton-Laison Company of Hastings, Nebr. Alternative crank mechanisms, ratchet systems or winch devices can be utilized.

Pole member 12 is shown in FIG. 1 detached from mounting structure 14. Pole member 12 includes a bearing 42. Bearing 42 can be a support ring for holding or securing pole member 12 to mounting structure 14. The combination of winch assembly 16, bearing 42, and pole member 12 forms a pole assembly. Mounting structure 14 includes two channels 58, a bottom plate 62, a bearing 38 and a top plate assembly 40 and can be referred to as a pole mounting structure. Although located on pole member 12, bearing 42 can function as part of mounting structure 14 because it is used to secure member 12 to mounting structure 14 and hence to the billboard structure.

Top plate assembly 40 engages bearing 42. Preferably, bearing 42 is a polymer (such as nylon) bearing ring or hold ring slid about the circumference of pole member 12. Bearing 42 can slide within a slot 44 of top plate assembly 40 as pole member 12 is raised. A rubber cushion mount ring devices with a three-inch diameter or other mechanical stop can be used to prevent bearing 42 from sliding off of pole member 12. Top plate assembly 40 can be comprised of two plates welded together to define a channel or slot 44.

Mounting structure 14 can be attached to a billboard structure by welding or with clamps, bolts, nuts or other mechanical fastening devices. Advantageously, pole member 12 can be rotated on bearing 38 to various positions to ease the loading and unloading of materials, such as advertising copy, tri-vision slats, vinyls, extensions, equipment or tools on the billboard structure.

Figure 2:
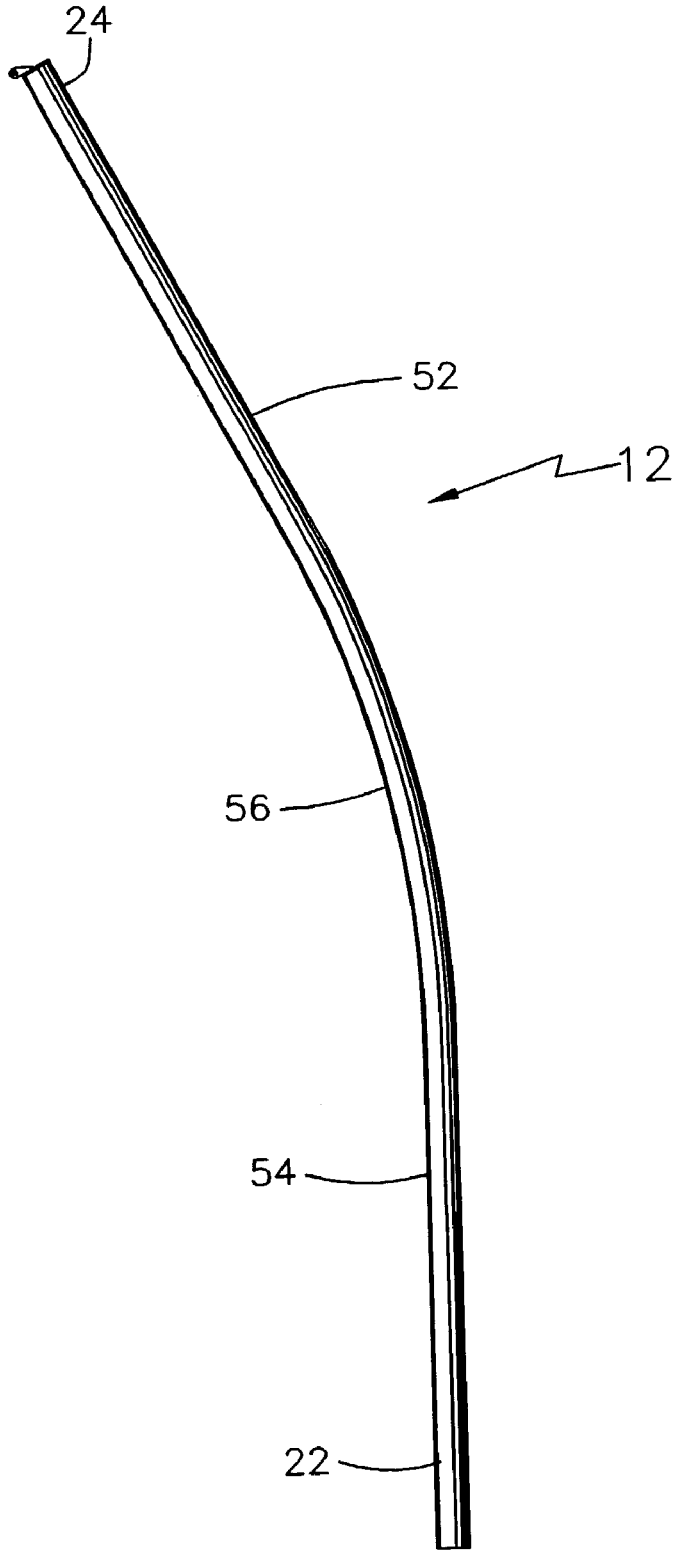
FIG. 2 is a more detailed schematic planar side view drawing of the pole member for the hoist system illustrated in FIG. 1 in accordance with another exemplary embodiment.

With reference to FIG. 2, pole member 12 is comprised of a first section 52 and a second section 54. First section 52 is preferably relatively straight, and second section 54 is preferably relatively straight. A radial section or bent section 56 is disposed between sections 52 and 54. Winch assembly 16 (FIG. 1) is attached towards the top end of section 54.

Exemplary dimensions for pole member 12 are given below. Pole member 12 preferably has an outside diameter of 3.5 inches and an inside diameter of 3.0 inches. Section 56 preferably has an arc length of 59 inches. Section 52 is disposed at a 37 degree angle with respect to section 54 and pole member 12 has a total length of 13 feet. Preferably, section 56 has a radius of 91.0 inches, and sections 52 and 54 have lengths of 37 and 60 inches, respectively. Alternatively, section 52 can be at an angle between 30 and 45 degrees with respect to section 54.

Advantageously, pole member 12 is manufactured from a composite material. In a preferred embodiment, pole member 12 is a single unitary piece having fibers placed or wound at angles in a range from 0 to 90 degrees. In one embodiment, pole member 12 includes fibers wound at an angle or combination of angles between 10 and 88 degrees. The fibers can be continuous fibers.

Applicants have found that a winding angle of approximately 35 degrees (e.g., 30–40 degrees) enables the formation of bent section 56 in accordance with the design criteria and application parameters associated with billboard hoist applications. In particular, a winding angle of approximately 35 degrees (e.g., 30–45 degrees) allows bent section 56 to be created so that section 52 is at a 37 degree angle (e.g., 1–90 degrees, more preferably 30–45 degrees) with respect to section 54. Embodiments of pole member 12 are not limited to the exemplary dimensions and angles given above unless expressly recited in the claims.

Pole member 12 is preferably a filament wound glass fiber composite pole having a high specific strength (e.g., approximately eight times stainless steel) and a very light weight (e.g., approximately one-fourth the weight of steel). Pole member 12 is preferably manufactured from an electrically non-conductive substance and is not subject to corrosion or affected by outdoor exposure. Therefore, the composite material provides a high strength, lightweight, long life, weather resistant, non-conductive pole member 12.

Although a continuous fiber filament winding is the preferred manufacturing process for pole member 12, other manufacturing processes could be used such as pultrusion, filament placement, centrifugal casting, tape placement, braiding, etc. Although the preferred reinforcing material is fiberglass fibers, other reinforcing fibers could be used, such as graphite/carbon fibers, aramid/Kevlar® fibers, polypropylene fibers, polyester fibers, nylon fibers, boron fibers, etc. The fibers can be long fibers or continuous fibers.

Although epoxy resin with an anhydride promoter or curing agent is the preferred resin or matrix system, other thermoset resins such as polyester, vinylester, etc. could be used with appropriate promoters. Some thermoplastic resin systems could also be used. Prepreg fibers, which are fibers that have been pre-impregnated with a resin system, could also be used as the material of choice for pole member 12. Additives such as ultraviolet light absorbers, colorants, catalysts and the like can be employed in manufacturing pole member 12.

The tensile strength of the continuous fiber-resin matrix composite material of pole member 12 is advantageously high for its weight. Theoretically, the maximum tensile strength properties are achieved when the fiber alignment matches the direction of the imposed load. Assuming the length of pole member 12 to be the axis, maximum tensile strength of pole member 12 would have the fibers lay along the axis (or at a 0 degree angle to the axis). The actual (practical) angle of lay will be influenced by the manufacturing process. Composite pultrusion will permit a 0 degree lay angle. Filament winding will not necessarily permit a 0 degree lay angle.

A preferred manufacturing process for pole member 12 is filament winding; it is a cost efficient process to achieve an optimum weight pole member 12 with a selection (or combination) of wind angles to meet strength and durability requirements. If pole member 12 is to be bent in one piece (the preferred method), the wind angle(s) chosen may produce a pole member 12 that has less than maximum strength to permit the bending operation to occur using the preferred method, which is to start with a straight filament wound part and perform the bend in a secondary operation. The winding could be performed on a bent mandrel, but this method can result in higher tooling and handling costs.

In another embodiment, the optimum and preferred winding angles for an exemplary pole member 12 are between 15 to 70 degrees. Higher winding angles could theoretically be used but the thickness and weight of pole member 12 would be greater than the part produced with the optimum winding angles or combination of winding angles. The weight fraction of the reinforcing glass fibers in the resin can be 45–90 percent.

Figure 10:
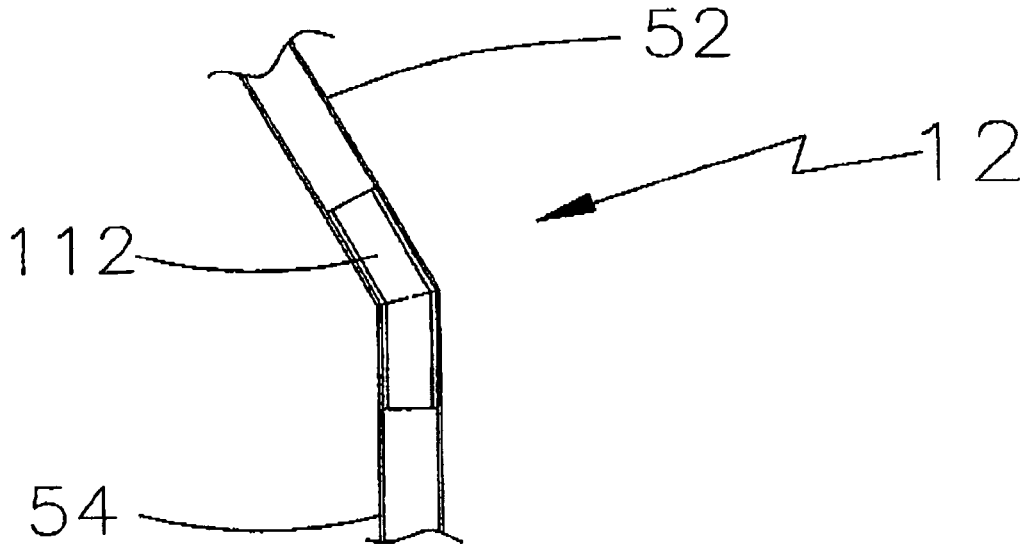
FIG. 10 is a schematic side view of a pole member including an internal bracket.
Figure 11:
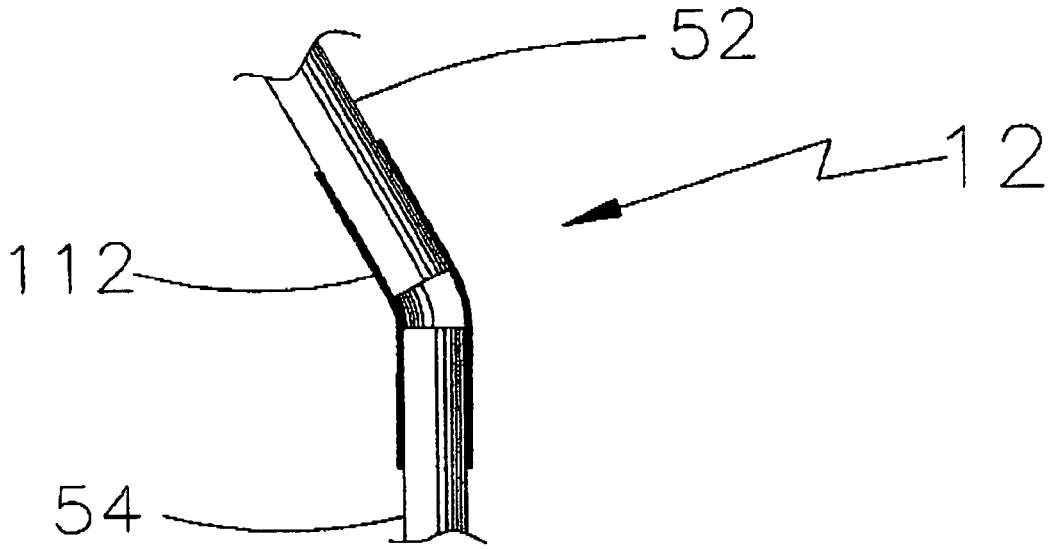
FIG. 11 is a schematic side view of a pole member including an external bracket.

In an alternative embodiment in FIG. 10, pole member 12 can be an assembly manufactured from several sections or segments of poles. Preferably, non-metallic segments of poles can be joined together with an angle bend or other bracket to create a bent pole or assembly such as pole member 12. In one embodiment, a bent member or bracket 112 made of a material other than corrosive steel can be utilized to join sections similar to sections 52 and 54. In this embodiment, sections 52 and 54 can slide over a bent member, and bent section 56 is not necessary. The bent member can be comprised of stainless steel, aluminum, a composite material, non-corrosive (or corrosion resistant) materials, or other lightweight materials with sufficient strength. In another embodiment, the bent member can be slid over sections 52 and 54 (FIG. 11).

In another embodiment, bent section 56 can be reinforced with windings over the outside circumference of member 12. Alternatively, or in addition, additional windings can be provided on the inside of section 56 for reinforcement.

Due to the lightweight construction of pole member 12 (e.g., in a preferred embodiment of composite material construction), pole member 12 can be lifted by a single person to the top of a billboard and does not require additional crane materials or boom trucks. Further, the non-metallic material associated with pole member 12 reduces risks associated with lightning and power lines. The material associated with pole member 12 is also advantageously impact resistant and has a safe failure mode where pole member 12 has an observable, localized, progressive failure mode of the fiber and resin system but will not completely sever during failure under design load levels.

Figure 3:
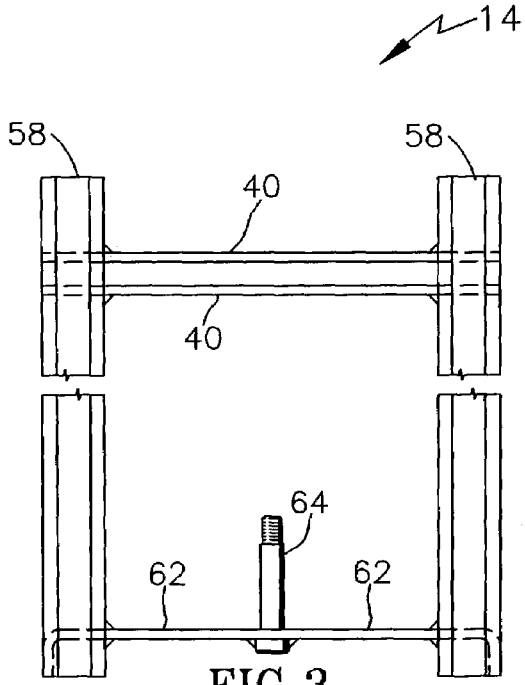
FIG. 3 is a more detailed schematic planar rear view drawing of components of the mounting structure for the hoist system illustrated in FIG. 1 in accordance with still another exemplary embodiment.

With reference to FIG. 3, mounting structure 14 preferably includes a top plate assembly 40, a pair of channels 58 and a bottom plate 62. Bottom plate 62 includes a welded bolt 64 for attachment of bearing 38 (FIG. 1). In one embodiment, mounting structure 14 is 42 inches in length.

Figure 7:
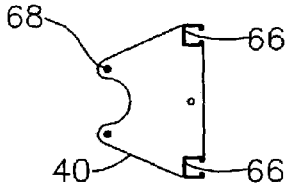
FIG. 7 is a more detailed schematic planar top view drawing of a top plate assembly for the mounting structure illustrated in FIG. 3 in accordance with yet another exemplary embodiment.
Figure 6:
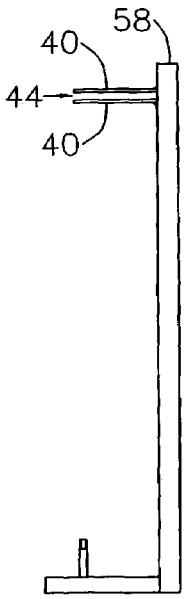
FIG. 6 is a more detailed schematic planar side view drawing of the components of the mounting structure illustrated in FIG. 3.
Figure 4:
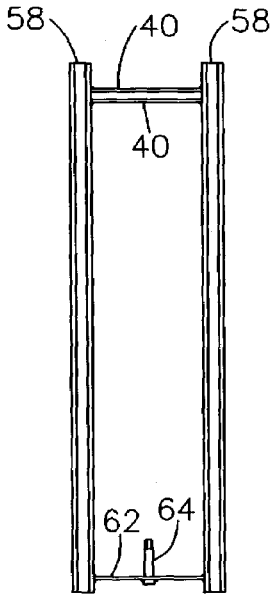
FIG. 4 is a schematic planar rear view drawing of the components illustrated in FIG. 3.
Figure 5:
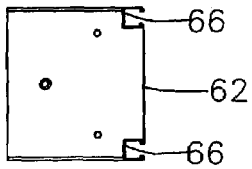
FIG. 5 is a more detailed schematic planar bottom view drawing of a bottom plate for the mounting structure illustrated in FIG. 1.

With reference to FIGS. 6 and 7, top plate assembly 40 is attached to channels 58 at apertures 66. Top plate assembly 40 includes slot 44 configured to receive ring bearing 42 (FIG. 1). Top plate assembly 40 includes apertures 68 through which pins can be inserted to secure bearing 42 in slot 44. With references to FIGS. 3, 5 and 6, bottom plate 62 also includes apertures 66 for receiving channels 58.

Channels 58 allow adequate structural support in the unique and variable conditions associated with billboard structures. Channels 58 provide a structurally sound mounting assembly for 360 degree operation.

Figure 8:
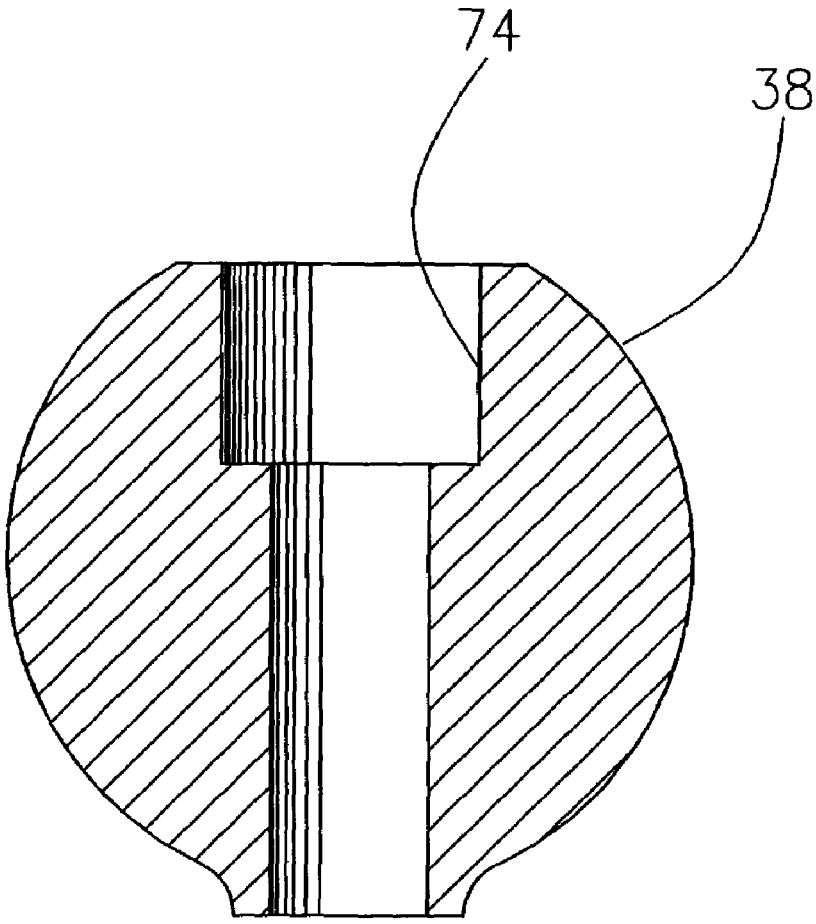
FIG. 8 is a more detailed schematic planar cross section view drawing of a mounting ball for the mounting structure illustrated in FIG. 3 in accordance with still another exemplary embodiment.

With reference to FIG. 8, bearing 38 is preferably a partially-spherical member and includes an aperture 74. Bearing 38 can be made from aluminum or other corrosion resistant materials. Bearing 38 preferably has a radius of 1.47 inches, and aperture 74 has a maximum diameter of 1.125 inches and a minimum diameter of 0.69 inches. Aperture 74 is preferably configured to receive bolt 64 on bottom plate 62. The shape of bearing 38 advantageously allows rotation of pole member 12 in two directions. The ability to rotate pole member 12 on bearing 38 in two perpendicular planes facilitates the attachment of pole member 12 to mounting structure 14.

Alternatively, bearing 38 can be a cylindrical member or a bracket for holding pole member 12 to mounting structure 14. In one embodiment, bearing 38 is a composite or plastic cylindrical member which fits within section 54 or around section 54.

Figure 9:
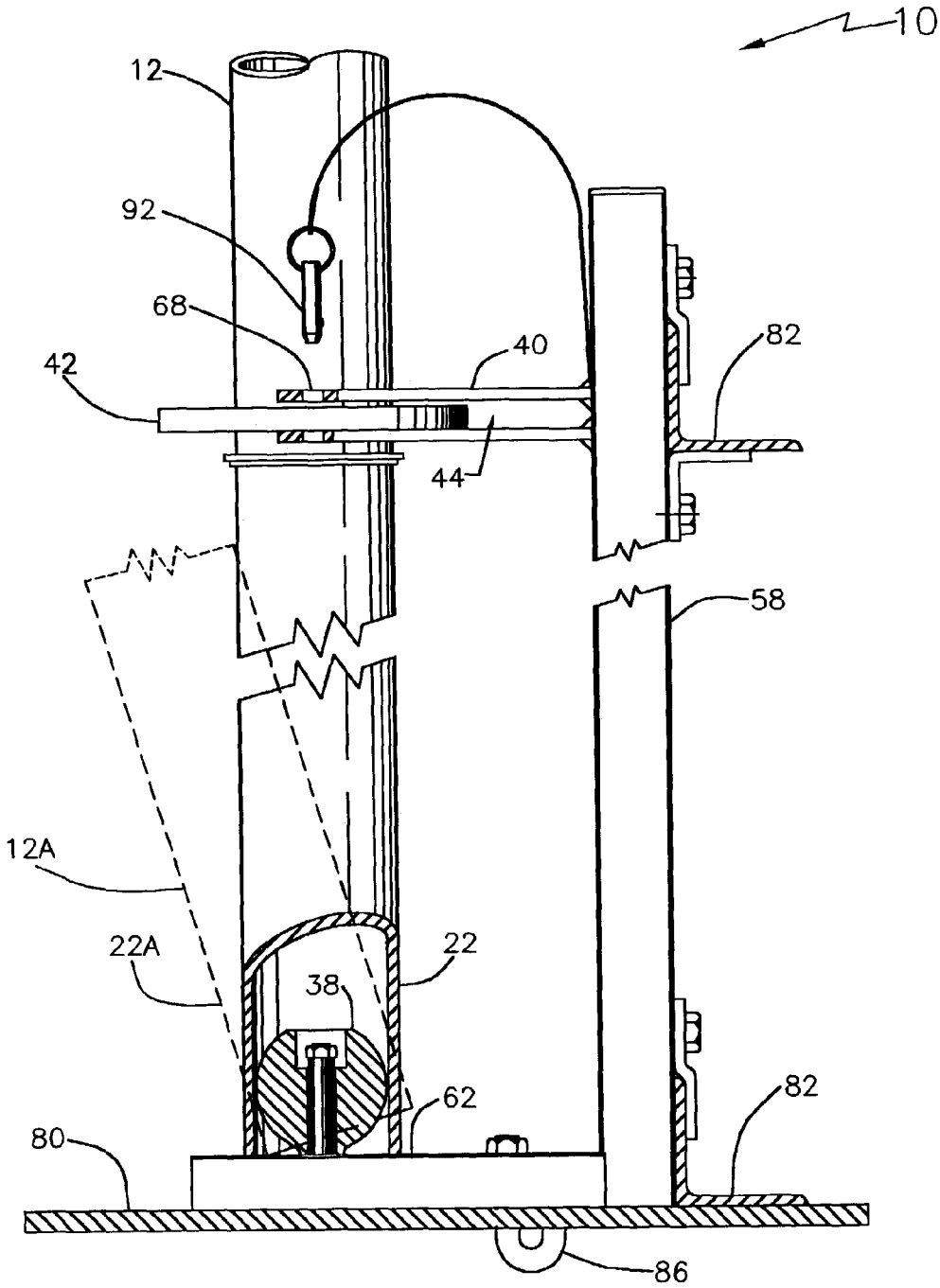
FIG. 9 is a schematic planar side view drawing of the hoist system illustrating the assembly for operation of the hoist system illustrated in FIG. 1 in accordance with yet another exemplary embodiment.

With reference to FIG. 9, the operation of hoist system 10 and the attachment of hoist system 10 to a billboard structure is described below as follows. Preferably, channel 58 of mounting structure 14 can be attached to a walkway structure 80 of a billboard structure. In one embodiment, the walkway structure can include angle irons 82 to which mounting structure 14 can be bolted via Z-supports and fasteners. In addition, bottom plate 62 (FIG. 3) can be attached directly to the walkway structure through J-bolts 86, T-bolts or other bolts. The particular attachment shown in FIG. 9 to a billboard structure is not shown in a limiting fashion. Mounting structure 14 (FIG. 1) can be attached to a billboard structure by a variety of methods, hardware, brackets, and fasteners, including through the use of welding.

In FIG. 9, pole member 12A is shown in phantom lines and is tilted as end 22A is placed over bearing 38 and rotated upward until bearing 42 engages slot 44 of top plate assembly 40. Pole member 12 is shown in solid lines as installed into mounting structure 14 with end 22 disposed over bearing 38. The lightweight nature of pole member 12 allows a single operator to plate end 22 over bearing 38 and pivot member 12 up to a fastening position in which bearing 42 engages slot 44.

Once bearing 42 engages slot 44, both pins 92 are slid through apertures 68 (FIG. 7) to lock bearing 42 in place. Preferably, bearing 42 is a non-metallic substance to avoid cutting and wear on pole member 12. Applicants have found that a metallic bearing on the outside of pole member 12 can cut into the composite material associated with a preferred embodiment of pole member 12. Locking bearing 42 in place secures pole member 12 to mounting structure 14. Preferably, winch assembly 16 is clamped on pole member 12 at a point above bearing 42 and below end 24.

The at least somewhat spherical shape of mounting ball 38 allows a single person to set pole member 12 over mounting ball 38 and slowly bring it into engagement, thereby easing the placement of pole member 12 so that one person can assemble hoist system 10. Alternative mounting hardware can be utilized without departing from the scope of the invention.

In one embodiment, hoist system 10 can be permanently attached to the billboard structure, requiring that an operator merely bring a portable electric hand drill to raise and lower line 28. Preferably, top attachments for mounting structure 14 are at least 36 inches above the base of the structure and at least 30 inches above the location of the lower attachments. Alternatively, mounting structure 14 can be welded to the billboard structure. Channel extensions can be attached to channels 58 if necessary.

In another embodiment, two mounting structure assemblies 14 are employed on a single billboard structure. If two assemblies 14 are utilized at opposite ends of the billboard structure, a single pole assembly (pole member 12, bearing 42, and winch assembly 16) can be used to handle vinyls that are rolled in a uniform direction.

After installation of vinyls, hoist system 10 can be disassembled and the pole assembly strapped to the billboard structure for storage. Pole member 12 should be strapped or bracketed at section 56, with end 22 resting on the bottom of the catwalk.

It is understood that although the detailed drawings, specific examples, materials and particular values given provide exemplary embodiments of the present invention, the exemplary embodiments are for the purpose of illustration only. The method and apparatus in the aforementioned embodiments are not limited to the precise details and descriptions disclosed. For example, although particular mounting positions are described, other mounting structures can be utilized. Various changes may be made to the details disclosed without departing from the scope of the invention which is defined by the following claims.

What is claimed is:

1. A lightweight hoist system for raising and lowering vinyl sign faces or extensions for a billboard having a billboard structure including a walkway, the hoist system comprising:

a cantilevered lightweight pole assembly with a lightweight fiber reinforced polymer pole member and a winch assembly, the pole member having a first relatively straight portion and a second relatively straight portion, wherein a bend is situated between the first portion and the second portion, wherein the first relatively straight portion is at an angle with respect to the second relatively straight portion, wherein the pole member has a length, the length and the angle being sufficient to provide adequate height and reach to handle the vinyl sign faces or extension from the walkway for installation and for removal;

a mounting structure allowing the lightweight pole assembly to be easily fastened and unfastened from a raising and lowering position by a single person and wherein the mounting structure is able to be attached to the billboard structure; and the winch assembly having at least one component coupled to the pole member, the winch assembly being capable of winding a flexible line, wherein the winch assembly can be used to raise or lower the vinyl sign faces or extensions via the flexible line, wherein the lightweight pole assembly can be easily carried on the walkway of the billboard and stored out of viewing sight on the billboard structure by the single person.

2. The lightweight hoist system of claim 1, wherein the pole member is attached to the mounting structure at two places on the first portion.

3. The lightweight hoist system of claim 1, wherein the pole member is a single continuous piece from the first relatively straight portion to the second relatively straight portion.

4. The lightweight hoist system of claim 1, wherein the angle is 30–45 degrees.

5. The lightweight hoist system of claim 4, wherein the angle is approximately 37 degrees.

6. The lightweight hoist system of claim 4, wherein the pole member includes fibers wound at a wind angle or combination of wind angles in a range of 10 to 88 degrees.

7. The lightweight hoist system of claim 4, wherein the pole member includes fibers disposed at an angle or combination of angles in a range of 10 to 88 degrees.

8. The lightweight hoist system of claim 7, wherein the pole member fibers are disposed at an angle or combination of angles in a range of 30 to 40 degrees.

9. The lightweight hoist system of claim 8, wherein the bend includes fibers fabricated at an initial wind angle or combination of wind angles of approximately of 30 to 40 degrees.

10. The lightweight hoist system of claim 1, wherein the weight fraction of the fibers of the lightweight fiber reinforced polymer pole member is between 45 and 90 percent.

11. A lightweight hoist system for raising and lowering vinyl sign faces or extensions for a billboard having a billboard structure including a walkway, the hoist system comprising:

a cantilevered lightweight pole assembly with a lightweight fiber reinforced polymer pole member and a winch assembly, the pole member having a first relatively straight portion and a second relatively straight portion, wherein a bend is situated between the first portion and the second portion, wherein the first relatively straight portion is at an angle with respect to the second relatively straight portion, wherein the pole member has a length, the length and the angle being sufficient to provide adequate height and reach to handle the vinyl sign faces or extension from the walkway for installation and for removal;

a mounting structure allowing the lightweight pole assembly to be easily fastened and unfastened from a raising and lowering position by a single person and wherein the mounting structure is able to be attached to the billboard structure; and the winch assembly having at least one component coupled to the pole member, the winch assembly being capable of winding a flexible line, wherein the winch assembly can be used to raise or lower the vinyl sign faces or extensions via the flexible line, wherein the lightweight pole assembly can be easily carried on the walkway of the billboard and stored out of viewing sight on the billboard structure by the single person, wherein the pole assembly has a reach of approximately 4 feet, wherein the bend is at an angle of approximately 37 degrees.

12. A lightweight hoist system for raising and lowering vinyl sign faces or extensions for a billboard having a billboard structure including a walkway, the hoist system comprising:

a cantilevered lightweight pole assembly with a lightweight fiber reinforced polymer pole member and a winch assembly;

a mounting structure allowing the lightweight pole assembly to be easily fastened and unfastened from a raising and lowering position by a single person, the mounting structure being for a more permanent mechanical attachment to the billboard structure than the fastening of the lightweight pole assembly to the mounting structure;

the winch assembly having at least one component coupled to the pole member, the winch assembly being capable of winding a flexible line, wherein the winch assembly can be used to raise or lower the vinyl sign faces or extensions via the flexible line, wherein the lightweight pole assembly can be easily unfastened from the mounting structure and stored out of viewing sight on the billboard structure by the single person, the mounting structure remaining attached to the billboard structure when the lightweight pole assembly is stored;

wherein the mounting structure holds the lightweight pole assembly at a first position and at a second position, the first position being separate and distinct from the second position; and wherein the lightweight pole assembly includes a first portion and a second portion, the first portion being separated from the second portion by a bend, wherein the first position is on the first portion and the second position being on the first portion.

13. The lightweight hoist system of claim 12, wherein mounting structure includes a first means for holding the lightweight pole assembly and a second means for holding the lightweight pole assembly.

14. The lightweight hoist system of claim 12, wherein the mounting structure includes a spherical bearing for holding the lightweight pole assembly at the first position.

15. The lightweight hoist system of claim 12, wherein the mounting structure includes a slot for receiving a polymer hold and wear member disposed about the light weight pole assembly at the second position.

16. The lightweight hoist system of claim 15, wherein the mounting structure includes at least one removable pin that secures the polymer hold and wear member within the slot.

17. A lightweight hoist system for raising and lowering vinyl sign faces or extensions for a billboard having a billboard structure including a walkway, the hoist system comprising:

a cantilevered lightweight pole assembly with a lightweight fiber reinforced polymer pole member and a winch assembly;

a mounting structure allowing the lightweight pole assembly to be easily fastened and unfastened from a raising and lowering position by a single person, the mounting structure being for a more permanent mechanical attachment to the billboard structure than the fastening of the lightweight pole assembly to the mounting structure;

the winch assembly having at least one component coupled to the pole member, the winch assembly being capable of winding a flexible line, wherein the winch assembly can be used to raise or lower the vinyl sign faces or extensions via the flexible line, wherein the lightweight pole assembly can be easily unfastened from the mounting structure and stored out of viewing sight on the billboard structure by the single person, the mounting structure remaining attached to the billboard structure when the lightweight pole assembly is stored; and wherein the mounting structure includes a sphere, wherein an end of the pole member is disposed over the sphere when in use, the pole member being able to be rotated on the sphere over at least two dimensions.

18. The lightweight hoist system of claim 17, wherein the mounting structure holds the lightweight pole assembly at a first position and at a second position, the first position being separate and distinct from the second position, the second position being the end of the pole.

19. The lightweight hoist system of claim 18, wherein the lightweight pole assembly includes a first portion and a second portion, the first portion being separated from the second portion by a bend, wherein the first position is on the first portion and the second position being on the first portion.

20. The lightweight hoist system of claim 19, wherein the first portion has an end, the end being at a bottom of the lightweight pole assembly when in use.

21. A lightweight hoist system for raising and lowering vinyl sign faces or extensions for a billboard having a billboard structure including a walkway, the hoist system comprising:

a cantilevered lightweight pole assembly with a lightweight fiber reinforced polymer pole member and a winch assembly;

a mounting structure allowing the lightweight pole assembly to be easily fastened and unfastened from a raising and lowering position by a single person, the mounting structure being for a more permanent mechanical attachment to the billboard structure than the fastening of the lightweight pole assembly to the mounting structure;

the winch assembly having at least one component coupled to the pole member, the winch assembly being capable of winding a flexible line, wherein the winch assembly can be used to raise or lower the vinyl sign faces or extensions via the flexible line, wherein the lightweight pole assembly can be easily unfastened from the mounting structure and stored out of viewing sight on the billboard structure by the single person, the mounting structure remaining attached to the billboard structure when the lightweight pole assembly is stored; and wherein a non-metallic hold and wear member is disposed about the pole member, the hold and wear member being for engagement with the mounting structure.

22. A lightweight hoist system for raising and lowering vinyl sign faces or extensions for a billboard having a billboard structure including a walkway, the hoist system comprising:

a cantilevered lightweight fiber reinforced polymer pole member, the pole member having a first portion and a second portion, wherein a bend is situated between the first portion and the second portion, wherein a first end of the bend is disposed at an angle of 30–45 degrees with respect to a second end of the bend, wherein the pole member has a length, the length and the angle being sufficient to provide adequate height and reach to handle the vinyl sign faces or extension from the walkway for installation and for removal;

a mounting structure allowing the lightweight pole assembly to be fastened and unfastened from a raising and lowering position by a single person and wherein the mounting structure is able to be attached to the billboard structure; and a winch assembly having at least one component coupled to the pole member, the winch assembly being capable of winding a flexible line, wherein the winch assembly can be used to raise or lower the vinyl sign faces or extensions via the flexible line.

23. A lightweight hoist system for raising and lowering vinyl sign faces or extensions for a billboard having a billboard structure including a walkway, the hoist system comprising:

a cantilevered lightweight pole assembly with a non-conducting lightweight fiber reinforced polymer pole member, the pole member having a first portion and a second portion, wherein a bend is situated between the first portion and the second portion, wherein a first end of the bend is disposed at an angle with respect to a second end of the bend, wherein the pole member includes fibers disposed at an angle between 20–40 degrees, wherein the pole member has a length, the length and the angle being sufficient to provide adequate height and reach to handle the vinyl sign faces or extension from the walkway for installation and for removal;

a mounting structure allowing the lightweight pole assembly to be fastened and unfastened from a raising and lowering position by a single person and wherein the mounting structure is able to be attached to the billboard structure; and a winch assembly having at least one component coupled to the pole member, the winch assembly being capable of winding a flexible line, wherein the winch assembly can be used to raise or lower the vinyl sign faces or extensions via the flexible line.

24. The lightweight hoist system of claim 23, wherein the pole member is a single continuous piece from the first relatively straight portion to the second relatively straight portion.

25. The lightweight hoist system of claim 23, wherein the angle is 30–45 degrees.

26. A lightweight hoist system for raising and lowering vinyl sign faces or extensions for a billboard having a billboard structure including a walkway, the hoist system comprising:

a cantilevered lightweight pole assembly with a non-conductive single piece lightweight fiber reinforced polymer pole member, the pole member having a first relatively straight portion and a second relatively straight portion, wherein a bend is situated between the first portion and the second portion, wherein a first end of the bend is disposed at an angle of 30–45 degrees with respect to a second end of the bend, wherein the pole member has a length, the length and the angle being sufficient to provide adequate height and reach to handle the vinyl sign faces or extension from the walkway for installation and for removal;

a mounting structure allowing the lightweight pole assembly to be fastened and unfastened from a raising and lowering position by a single person and wherein the mounting structure is able to be attached to the billboard structure; and a winch assembly having at least one component coupled to the pole member, the winch assembly being capable of winding a flexible line, wherein the winch assembly can be used to raise or lower the vinyl sign faces or extensions via the flexible line, the bend includes fibers disposed at an angle or combination of angles in a range of 10 to 88 degrees.

* * * * *